US005772151A

United States Patent [19]

Teng

[11] Patent Number: 5,772,151

[45] Date of Patent: Jun. 30, 1998

[54] UMBRELLA TYPE QUICK WIRE REMOVAL DEVICE FOR WINDING MACHINES

[75] Inventor: Kui-Yu Teng, Chung Ho, Taiwan

[73] Assignee: U Gear Automatic Machinery Co., Ltd., Taipei Hsien, Taiwan

[21] Appl. No.: 874,227

[22] Filed: Jun. 13, 1997

[51] Int. Cl.[6] ..... B65H 75/24; B65H 54/00

[52] U.S. Cl. ..... 242/573; 242/18 R

[58] Field of Search ..... 242/362.2, 363, 242/360, 18 R, 470, 573, 573.7, 573.9, 607.1, 608.5

[56] References Cited

U.S. PATENT DOCUMENTS

| | | | |
|---|---|---|---|
| 1,670,886 | 5/1928 | Fellows | 242/573 |
| 2,529,185 | 11/1950 | Proctor | 242/607.1 |
| 2,662,701 | 12/1953 | Weber | 242/573 |
| 2,695,142 | 11/1954 | Fons et al. | 242/573 |
| 4,422,591 | 12/1983 | Van Maanen | 242/607.1 |
| 5,465,922 | 11/1995 | Vander Groef | 242/573 |

FOREIGN PATENT DOCUMENTS

| | | | |
|---|---|---|---|
| 641741 | 3/1984 | Switzerland | 242/573 |

*Primary Examiner*—Michael Mansen
*Attorney, Agent, or Firm*—Bacon & Thomas

[57] ABSTRACT

An umbrella type quick wire removal device for winding machines including a shaft, a shaft collar, an umbrella type pawl mechanism, an inner annular plate, a take mechanism, and an outer annular plate. The device is characterized in that, when the take mechanism is pulled outwardly along the direction of a main shaft of the shaft after the winding operation, guide wheels in base rods of the pawl mechanism lose support of a securing seat so that the base rods retract inwardly using the holes of the corresponding shaft brackets to allow removal of the wound wire. The pawl mechanism may be connected to wire guide so that an end of the bundle of wound wire may be passed out through a through hole for easy pulling of the wire.

5 Claims, 6 Drawing Sheets

UMBRELLA TYPE QUICK WIRE REMOVAL DEVICE FOR WINDING MACHINES

BACKGROUND OF THE INVENTION (a) Field of the Invention:

The present invention relates to an umbrella type quick wire removal device for winding machines.

(b) Description of the Prior Art:

Before delivery from factory, wires are generally wound into a ring shape with a hollow to facilitate carrying or transportation. The operation of winding wires into a ring is the so-called winding process.

In the past, winding was done by providing two pawls fixedly on a rotary disk and the entire bundle of wire was forcefully pulled out after winding was completed. A major drawback with this method is that the wire at the inner rim of the bundle is easily damaged. Besides, the production efficiency is low.

Directed to the above drawbacks in the art, manufacturers have developed a conical pawl capable of automatic wire withdrawing. It essentially comprises a rod connected onto a transmission shaft of the winding machine with the rod passing through a circular inner baffle plate, a conical inner mold and a circular outer baffle plate. A set screw disk is further provided to lock with the threads of the front rim of the rod to urge the above components so that the winding process may proceed. However, the conical components may still form obstacles during transportation and require complicated manual work. There is also the consideration of safety.

SUMMARY OF THE INVENTION

Accordingly, a primary object of the present invention is to provide an umbrella type quick wire removal device for winding machines, which enables quick removal of a wire bundle from the winding machine after the winding process without use of any tools, and the wire bundle may be conveniently tied up to prevent loosening. Besides, the wire wound may be circular or conical in shape, which is more pleasing.

Another object of the present invention is to provide an umbrella type quick wire removal device for winding machines, which reduces labor and cost.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
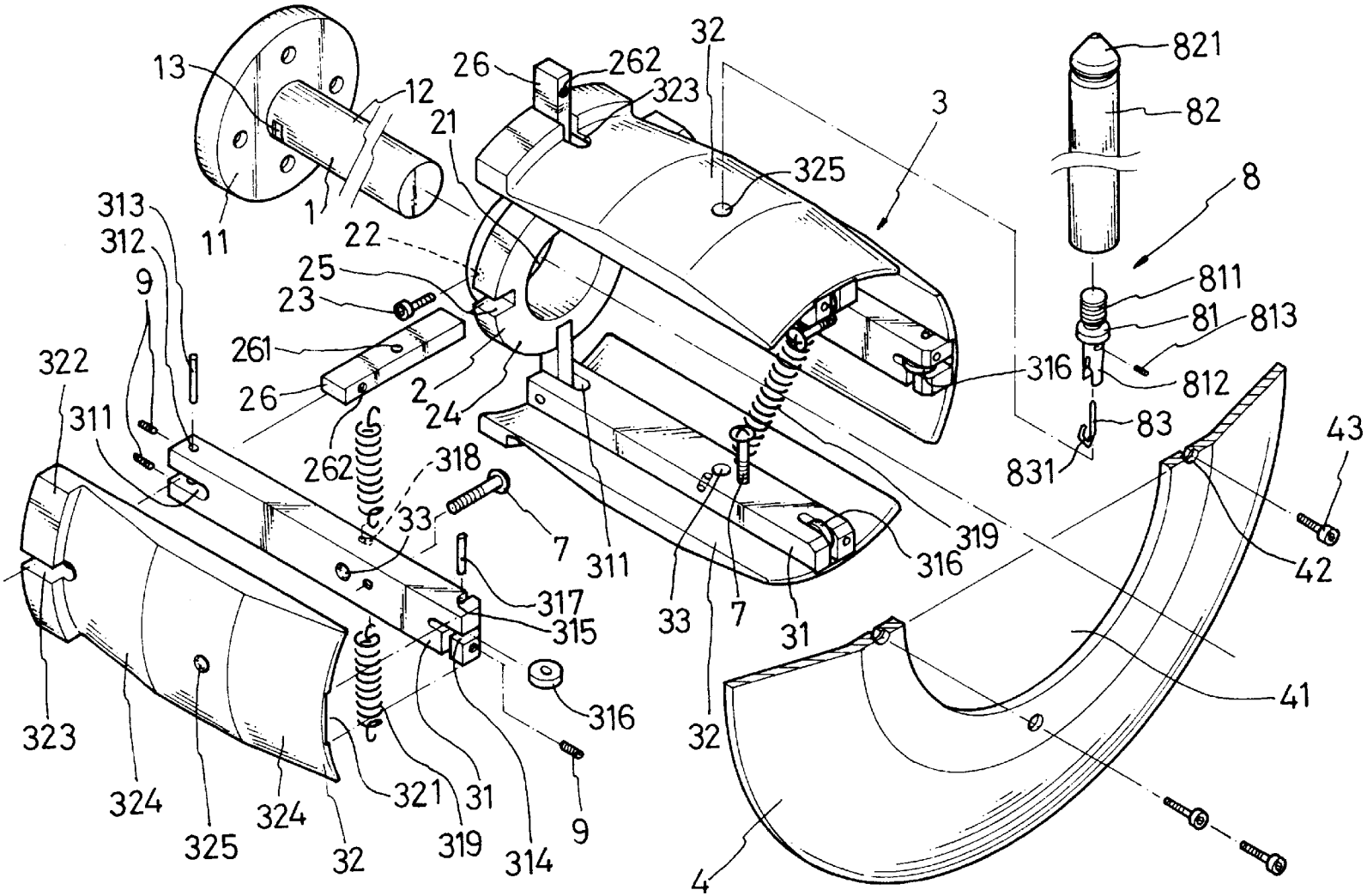
FIG. 1 is an elevational exploded view of the present invention.
Figure 2:
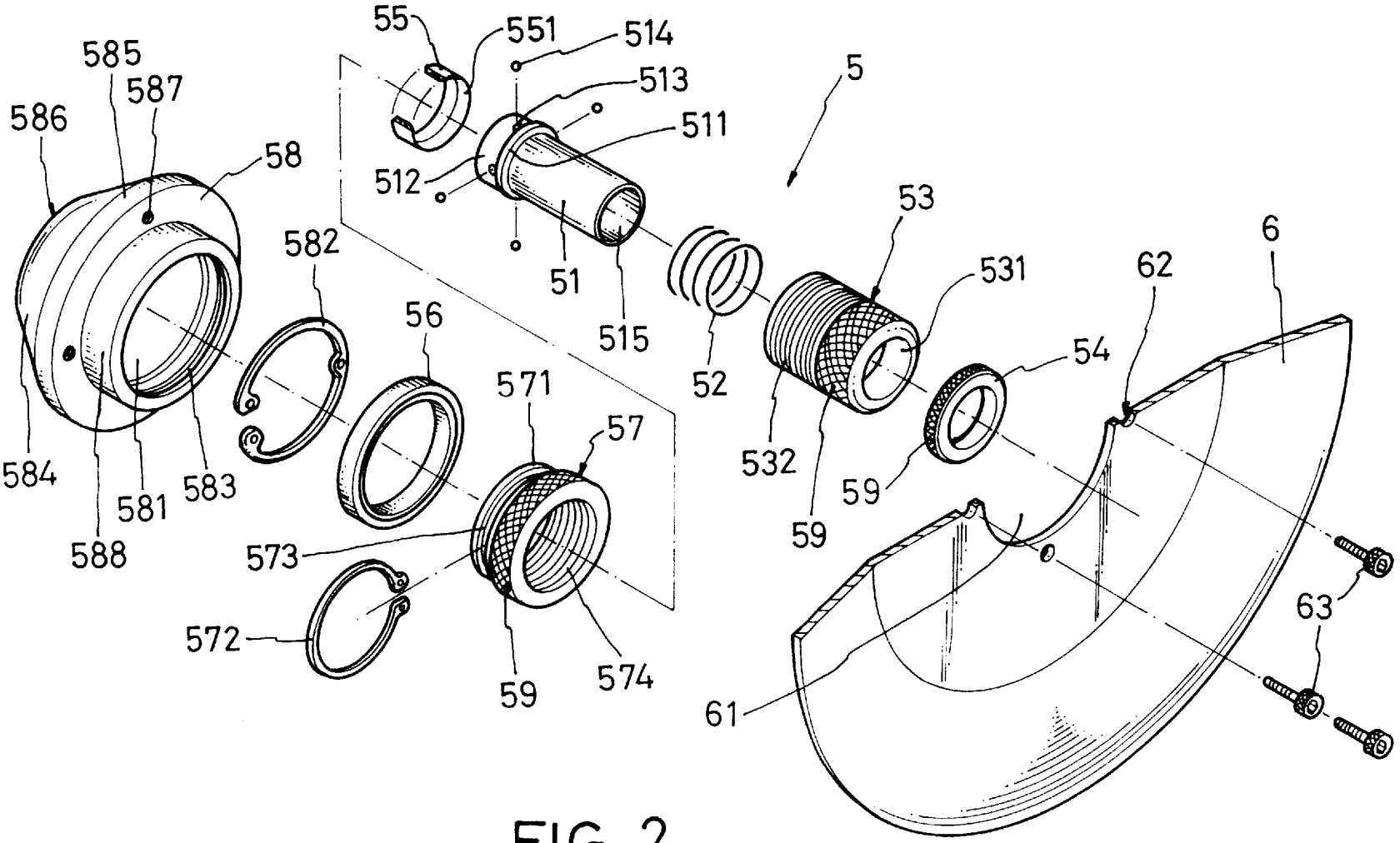
FIG. 2 is an elevational exploded view of take means and an outer annular plate of the present invention.

As shown in FIGS. 1 and 2, the present invention essentially comprises a shaft 1, a shaft collar 2, pawl means 3 in the shape of an umbrella, an inner annular plate 4, take means 5, and an outer annular plate 6.

Figure 3:
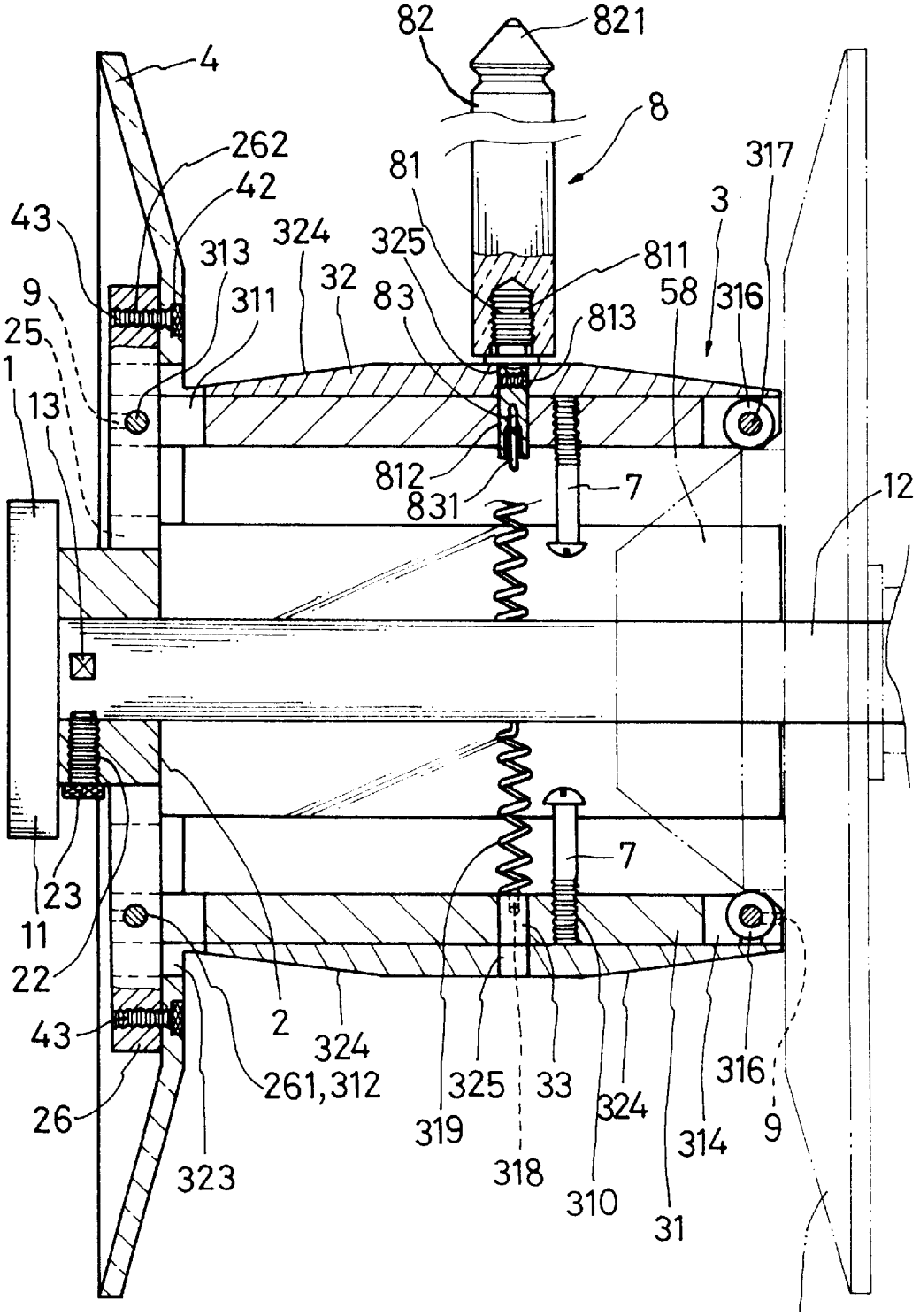
FIG. 3 is a schematic sectional view of the present invention in an assembled state.

As shown in FIGS. 1 and 3, the shaft 1 is an elongated rod which has a connecting disk 11 at one end for pivotal connection with an output shaft of a winding machine. A main shaft 12 extends from a front end of the connecting disk 11 for connection with the shaft collar 2 to achieve linking-up movement between the main shaft 12 and the shaft collar 2. The main shaft 12 is provided with a milled surface 13.

The shaft collar 2 is a hollow ring with an annular hole 21 at its center for receiving the main shaft 12. The shaft collar 2 is further provided with a lock hole 22 with threads for matching the milled surface 13, so that a screw 23 may pass through the lock hole 22 to urge against the milled surface 13 to secure the shaft 1 and the shaft collar 2 in position. In addition, three or more shaft notches are equi-angular formed on a collar body 24 of the shaft collar 2. Each notch 25 is radially welded to a shaft bracket 26. Each shaft bracket 26 is centrally provided with a longitudinal, through bracket hole 261. Each bracket 26 is further laterally provided with a threaded hole 262 for engaging the annular plate 4.

The pawl means 3 is comprised of base rods 31 and curved clamp plates 32 matching the brackets 26 in number. The curved clamp plates 32 together form an annular structure. Each base rod 31 is transversely connected to the middle of an inner surface of each curved clamp plate 32. A rear end of each base rod 31 has a U-shaped rear notch 311, and an insert hole 312 is longitudinally provided at the rear end as well. In this way, after its corresponding bracket 26 has aligned, a first pin 313 may pivotally lock the base rod 31 to the bracket 26 in a rotatable relationship. In addition, a front end of each base rod 31 is also provided with a front notch 313 having an eccentric hole 315 in a longitudinal direction. A guide wheel 316 is fitted into the front notch 314 so that a second pin 317 may pass through the eccentric hole 315 and the guide wheel 316 to secure the latter in the front notch 314, with a part thereof projecting in the direction of the main shaft 12. Furthermore, a hook hole 318 is formed at an upper side and a lower side of each base rod 31 at suitable positions in a longitudinal direction. Adjacent hook holes 318 respectively engage two ends of a reset spring 319, so that the base rod 31 and the curved clamp plate 32 may extend outwardly or retract with the bracket hole 261 as their pivot.

The inner surface of the above-mentioned curved clamp plate 32 is milled to form a plate groove 321 for connection with the base rod 31. At the position corresponding to the rear notch 311 of the base rod 31, the curved clamp plate 32 is provided with a stop rim 322 with a plate notch 323 for projection of the bracket 26 therethrough. Additionally, both sides of an outer surface of the curved clamp plate 32 are cut downwardly to form a plate rake 324 at either side so as to facilitate removal of wires.

Furthermore, in order to prevent the base rods 31 from being acted upon by the reset springs 319 to orient towards the main shaft 2 during retraction, which may damage the guide wheel 316, a stop hole 310 is transversely formed at a suitable position of each base rod for receiving a stop rod 7. In addition, in order to position the end of a to-be-wound material, or to insertably connect wire guide means 8 with the curved clamp plates 32, a through bore 325 is formed in each curved clamp plate 32, while the corresponding base rod 31 is provided with a through hole 33 matching the through bore 325 for passage and thus positioning of the wire end, or for insertable connection of the wire guide means 8.

The above-mentioned wire guide means 8 is comprised of a relay post 81, a wire guide rod 82, and a resilient hook 83. The relay post 81 has post threads 811 at an upper end for connection with the wire guide rod 82, which has a rod cone 821 at a top end. A lower end of the relay post 81 has a post end 812 corresponding to the through bore 325 and connecting to the resilient hook 83. By means of a stop screw 9 passing through the post end 812 to urge against the resilient hook 83, the resilient hook 83 may be held in the post end 812. At the same time, a bottom end of the resilient hook 83 has a hook end 831 in an eccentric shape and slightly exposed at the outside of the post end 812. When the post end 812 and the resilient hook 83 are inserted into the through bore 325 and the through hole 33, the hook end 831 will first be compressed, and when the hook end 831 extends through the through hole 33, it will reset so that the wire guide means 8 may be fixedly situated on the curved clamp plate 32.

The inner annular plate 4 is a saucer-like disk structure. It has an annular hole 41 corresponding to the baffle rim 322 of the pawl means 3, and a plate hole 42 corresponding to each threaded hole 262 of each bracket 26 so that screw rods 43 may be used to lock the inner annular plate 4 to the brackets 26 to achieve synchronous rotation with the shaft collar 2.

The take means 5 essentially comprises a liner 51, a spring 52, a bushing 53, a withdraw ring 54, and a tightening ring 55. The liner 51 has a liner ring 511 near an outer end and a liner groove 515 at its interior for passage of the main shaft 12. The liner 51 is fitted with the spring 52 and then passed through a bushing hole 531 of the bushing 53. Then the withdraw ring 54 is connected to an end of the liner 51. The liner 51 further has a liner loop 512 at an outer end, the liner loop 512 having three or more liner holes 513 each of which insertably receive a ball 514. The tightening ring 55 is then connected to the bushing hole 531 in a tight fit so that the balls 514 are located between the liner holes 513 and the tightening ring 55 and urge against the main shaft 12. In addition, the tightening ring 55 is provided with an oblique ring rake 551 for matching the positions of the balls 514, so that each ball 514 may, after being pressed by the ring rake 551, clamp the main shaft 12 or, when the the withdraw ring 54 is being pulled out, roll along the ring rake 551 to displace rearwardly so as to disengage from the main shaft 12.

At this point, a bearing 56 is connected to a ring surface 571 of an adjusting ring 57, and a first fastening ring 572 is used to engage an annular groove 573 of the ring surface 571. Then the bearing 56 and the adjusting ring 57 are together placed into a seat chamber 581 of a securing seat 58. Then a second fastening ring 582 is used to engage a chamber groove 583 in the seat chamber 581 to prevent slippage of the bearing 56. The securing seat 58 has a seat cone 584 at a front end and a planar seat ring 585. The seat cone 583 is internally provided with a seat hole 586 for passage of the main shaft 12. In addition, an inner surface of the seat ring 585 is provided with three or more connecting holes 587 for connection with the outer annular plate 6. Subsequently, the bushing 3 is connected to the adjusting ring 57 by engagement of bushing threads 532 at one end of the bushing 53 with ring threads 574 of the adjusting ring 57. Assembly of the take means 5 is thus accomplished.

Furthermore, in order to facilitate gripping and turning of the bushing 53, withdraw ring 54, and adjusting ring 57, they may be provided with press grooves 59 or the like.

The outer annular plate 6 is also a saucer-like disk structure. It has an annular hole 61 corresponding to a seat step 588 of the securing seat 58, and a plate hole 62 corresponding to each connecting hole 587 for passage of a screw 63 to lock them together.

Figure 4:
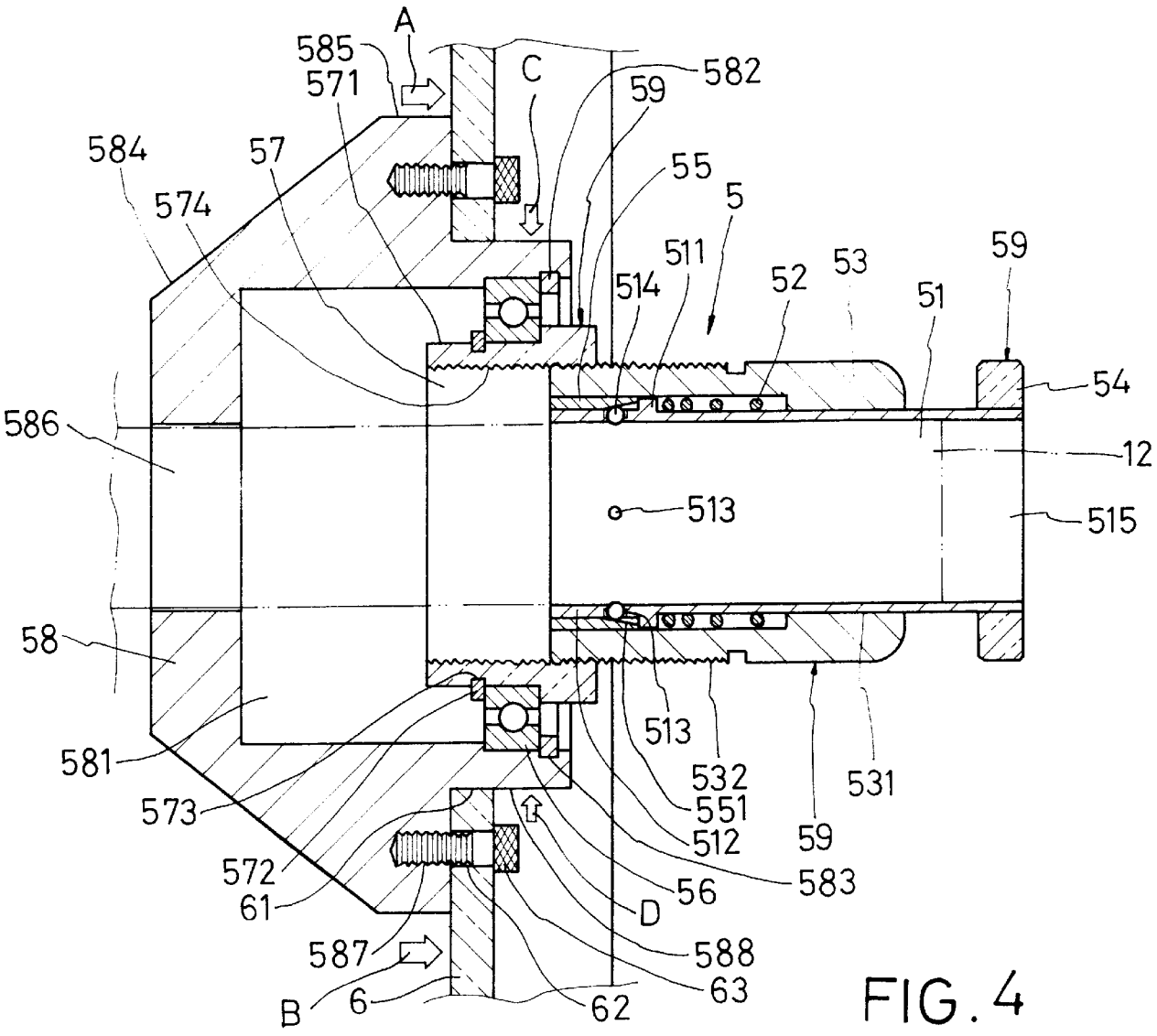
FIG. 4 is a schematic sectional view of the take means and outer annular plate of the present invention.
Figure 5:
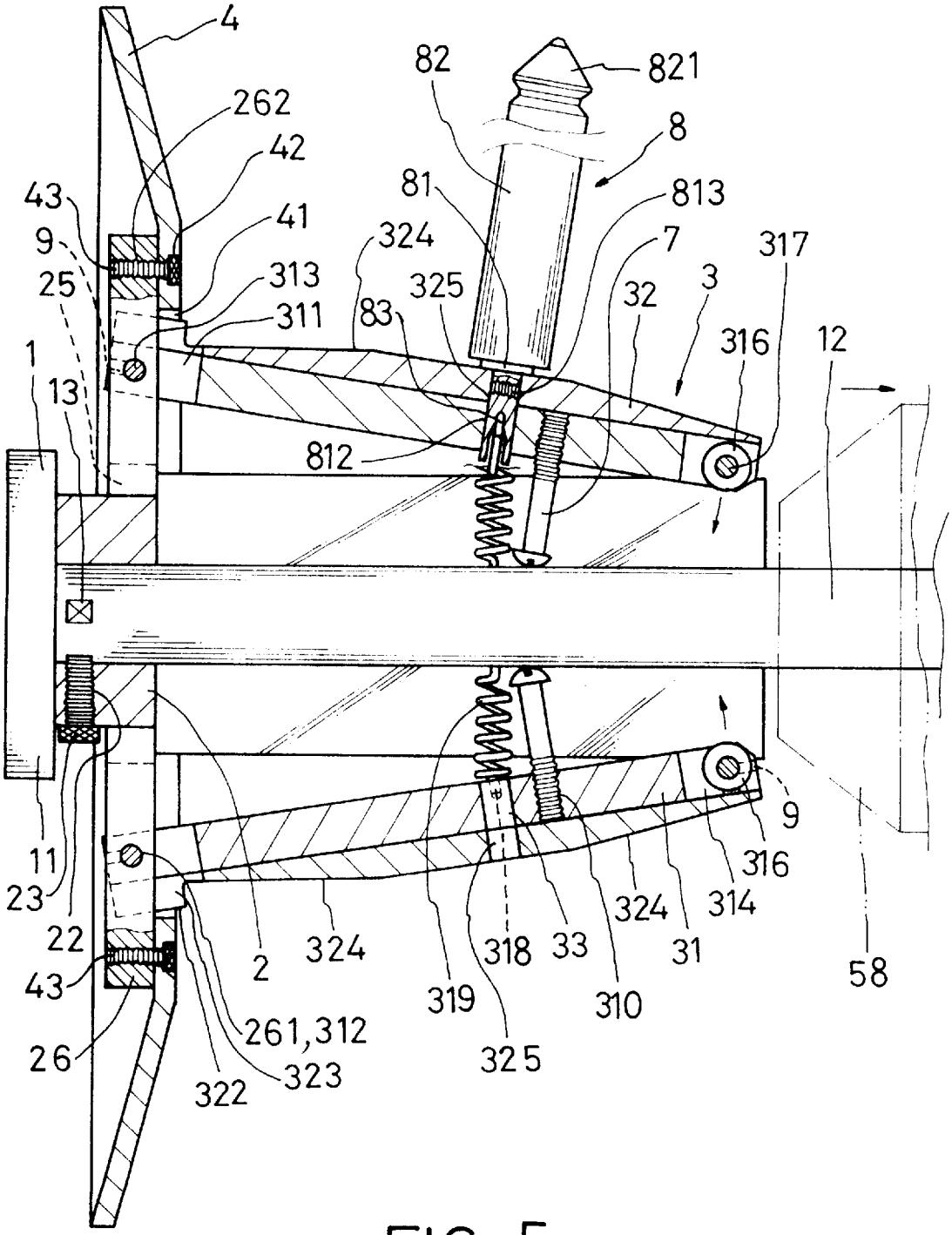
FIG. 5 is a schematic view illustrating operation of the present invention.

During assembly, the shaft collar 2 is firstly connected to the shaft 1, and the curved clamp plates 32 together with the base rods 31 are mounted on the shaft brackets 26 in order. After the first pins 313 are passed through corresponding insert holes 312 and bracket holes 261, stop screws 9 are caused to urge against corresponding first pins 313. Then the inner annular plate 4 is coupled to the shaft bracket 26 to for a side wall. Subsequently, the reset springs 319 respectively engage adjacent hook holes 318 so that one end of each curved clamp plate 32 is pivoted on the corresponding bracket hole 261, while the other end thereof is oriented towards the main shaft 12 in a retracted manner, as shown in FIG. 5. Additionally, the stop screws 9 urge against the corresponding second pins 317 so that they will not disengage from the eccentric holes 315. Finally, the take device 5 together with the outer annular plate 6 is inserted along the main shaft 12 into the pawl means 3. Due to the inclination of each guide wheel 316 along the seat cone 584, each curved clamp plate 32 may gradually extend outwardly, as shown in FIGS. 3 and 4. When the guide wheels 316 displace to the seat ring 585 and touch the outer annular plate 6, assembly is accomplished and winding operation may proceed.

In order to proceed with the winding operation, one end of the to-be-wound material is inserted into any one of the through bores 325 and/or through holes 33, then the post ends of the relay posts of the wire guide means 8 are inserted into the rest of the through bores 325 such that the hook ends 831 below pass through the through holes 33 and extend outwardly in a positioned state. At this time, by starting the winding machine so that its output shaft rotates and thus brings the shaft 1 to rotate therewith, the shaft collar 2, pawl means 3, inner annular plate 4, securing seat 58, bearing 56, and outer annular plate 6 will synchronous rotate therewith to achieve winding. When the material is wound orderly in an alternate manner on the pawl means 3 and touches the rod cone 821, it will wind downwardly along the wire guide rod 82, and when the material is stacked at the inner wall of the outer annular plate 6, since the tensile force (shown by arrows A and B in FIG. 4) generated by the material is converted into a radial pressure (indicated by arrows C and D), the balls 514 are pressed by the ring rake 551 to clamp the main shaft 12, so that the withdraw ring 54 along with the liner 51 cannot be pulled out.

Figure 6:
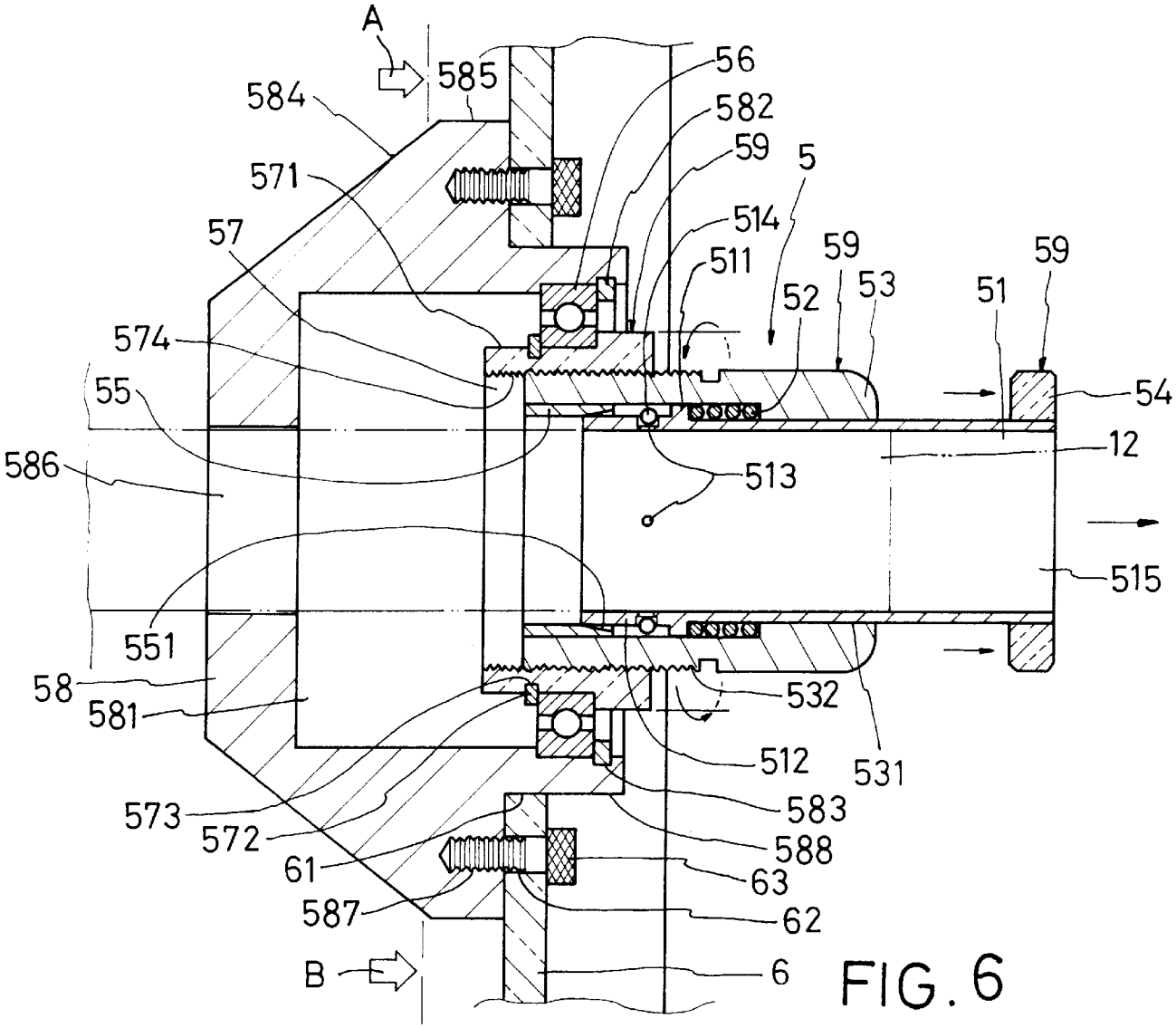
FIG. 6 is a schematic view of the operation of the take means.

After the winding operation is completed, the wire guide means 8 is firstly taken down so that the entire bundle of wire in the shape of a loop has a hollow in the center. Referring to FIG. 6, the operator may firstly hold the press grooves 59 of the bushing 53 with one hand and turn the adjusting ring 57 with the other hand in a counter-clockwise direction, so that the adjusting ring 57 displaces a certain distance outwardly along the bushing threads 532. At this point, the tensile force (arrows A and B) disappears, and the radial pressure relatively disappears as well, so that the ring rake 551 no longer press against the balls 514. Then the withdraw ring 54 and the liner 51 are pulled out together, so that the balls 514 disengage from the tightening ring 55. Therefore, the balls 514 no long clamp the main shaft 12, and the take means 5 and the outer annular plate 6 may be taken down. Since the guide wheels 316 are no longer supported by the seat ring 585, and the base rods 31 are acted upon by the reset spring 319 to retract inwardly, with the stop rods 7 touching the main shaft 12, each curved clamp plate 32 will not retract excessively inward. Then the entire bundle of wound wire may be removed.

In the present invention, there is no need to use any tools and the wound material may be quickly removed after the winding process. Besides, the bundle of wire may be tied by passing strings or ropes through the clearances between curved clamp plates 32 so that the bundle will not become loosened. At the same time, the pawl means may enable winding in a circular or conical shape, so that the material wound has a pleasing shape. Besides, labor and cost may be reduced.

Although the present invention has been illustrated and described with reference to the preferred embodiment thereof, it should be understood that it is in no way limited to the details of such embodiment but is capable of numerous modifications within the scope of the appended claims.

What is claimed is:

1. An umbrella type quick wire removal device for winding machines, comprising:

a shaft, said shaft having one end thereof connected to an output shaft of a winding machine, and a main shaft extending from the other end thereof;

a shaft collar, said shaft collar having an annular hole at a center thereof for connection with said main shaft, and a collar body, at least three shaft notches being equi-angular formed on said collar body, with each of said shaft notches radially connecting a shaft bracket, said shaft bracket having a bracket hole in a longitudinal direction;

an umbrella type pawl means, said pawl means being comprised of base rods and curved clamp plates corresponding to said shaft brackets in number and forming a cylindrical shape, each of said base rods having a rear notch for matching said bracket hole so that a pin may pass through said rear notch and said bracket hole to hold each of said base rods and its corresponding shaft bracket in a rotatable relationship, each of said base rods further having a rear notch for receiving a guide wheel and a guide wheel positioned therein by a pin, each of said curved clamp plates having a baffle rim and a plate groove for passage of said shaft bracket;

an inner annular plate, being a disk structure and being locked to said shaft brackets by screw rods;

take means, said take means being comprised of a liner, a spring, a bushing, a withdraw ring, a tightening ring, an adjusting ring, a bearing, and a securing seat, said liner having a liner ring near an outer end and a liner groove at an interior thereof for passage of said main shaft, said liner being fitted with said spring and passed through a bushing hole of said bushing, with said withdraw ring connected to an end of said liner, said liner further having a liner loop at an outer end, said liner loop having at least three liner holes each of which insertably receive a ball, said tightening ring being inserted into a rear end portion of said bushing so that a ring rake thereof is in contact with said ball in each of said liner holes, said adjusting ring having one end screwably coupled to said bushing and the other end connected to said bearing using a first fastening ring, said adjusting ring and said bearing being placed into a securing seat using a second fastening ring, said securing seat having an oblique seat cone, a planar seat ring, and a seat hole for passage of said main shaft; and an outer annular plate, being a disk structure and being locked to said securing seat with screw rods; whereby when said take means is being pulled outwardly along the direction of said main shaft when winding is accomplished, said adjusting ring is being turned firstly so that the tensile force and radial pressure of the wire disappear to allow pulling out of said adjusting ring, thereby disengaging said balls from said ring rake to allow removal of said take means, said guide wheels of said base rods being no longer supported by said securing seat so that said base rods may retract in a conical shape using the corresponding bracket holes as pivots.

2. An umbrella type quick wire removal device for winding machines as claimed in claim 1, wherein said base rods each have a hook hole at an upper side and a lower side thereof receiving one end of a reset spring, the other end of said reset spring being held in the hook hole of an adjacent base rod, so that said curved clamp plates are biased inwardly.

3. An umbrella type quick wire removal device for winding machines as claimed in claim 1, wherein said base rods each have a stop hole at an inner surface thereof in connection with a stop rod, so that said stop rod may stop said main shaft when said curved clamp plates are in a retracted state.

4. An umbrella type quick wire removal device for winding machines as claimed in claim 1, wherein said curved clamp plates and said base rods are respectively provided with through bores and through holes for insertable connection with wire guide means and a wire guide means inserted therein.

5. An umbrella type quick wire removal device for winding machines as claimed in claim 4, wherein said wire guide means is comprised of a relay post, a wire guide rod, and a resilient hook, said relay post having an upper end connected to said wire guide rod, and a post end at a lower end connected to said resilient hook, so that when said post end is inserted into one of said through bores and one of said through holes, a hook end of said resilient hook that is eccentric in shape engages said through hole to achieve positioning.

* * * * *